United States Patent [19]

Frame et al.

[11] Patent Number: 4,502,949

[45] Date of Patent: Mar. 5, 1985

[54] CATALYTIC OXIDATION OF MERCAPTAN IN PETROLEUM DISTILLATE

[75] Inventors: Robert R. Frame, Glenview; Russell W. Johnson, Villa Park; Bruce E. Staehle, Buffalo Grove, all of Ill.

[73] Assignee: UOP Inc., Des Plaines, Ill.

[21] Appl. No.: 580,490

[22] Filed: Feb. 15, 1984

[51] Int. Cl.[3] ..... C10G 27/10; C10G 29/00

[52] U.S. Cl. ..... 208/207; 208/189; 208/3

[58] Field of Search ..... 208/189, 207, 3

[56] References Cited

U.S. PATENT DOCUMENTS

| | | | |
|---|---|---|---|
| 2,080,365 | 5/1937 | von Fuchs et al. | 208/207 |
| 2,289,924 | 7/1942 | Morrell | 208/207 |
| 2,338,634 | 1/1944 | Fuchs | 208/3 |
| 2,455,670 | 12/1948 | Graves | 208/3 |
| 2,988,500 | 6/1961 | Gleim et al. | 208/206 |
| 3,392,111 | 7/1968 | Napier | 208/189 |
| 3,785,964 | 1/1974 | Chun et al. | 208/207 |

FOREIGN PATENT DOCUMENTS

| | | | |
|---|---|---|---|
| 596358 | 4/1960 | Canada | 208/207 |

*Primary Examiner*—Delbert E. Gantz
*Assistant Examiner*—Helane M. Myers
*Attorney, Agent, or Firm*—William H. Page, III; John G. Cutts

[57] ABSTRACT

A process for sweetening a sour hydrocarbon fraction containing mercaptan which comprises reacting mercaptan contained in the hydrocarbon fraction with an oxidizing agent by contacting the hydrocarbon fraction and the oxidizing agent with a supported metal chelate mercaptan oxidation catalyst and anhydrous ammonia in the absence of an aqueous phase.

12 Claims, 1 Drawing Figure

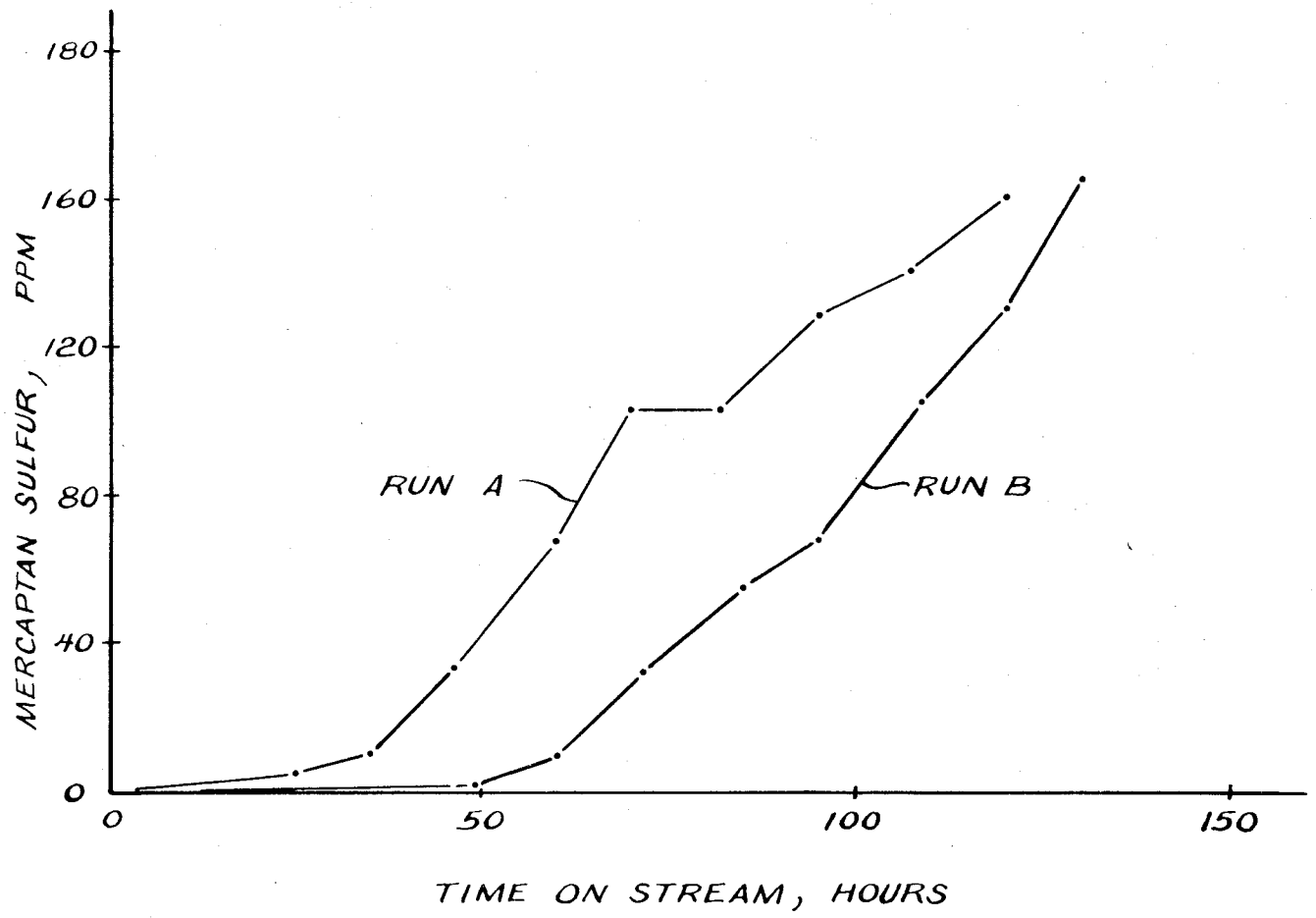
MERCAPTAN SULFUR, PPM
180
160
120
80
40
0
0
50
100
150
TIME ON STREAM, HOURS
RUN A
RUN B

CATALYTIC OXIDATION OF MERCAPTAN IN PETROLEUM DISTILLATE

BACKGROUND OF THE INVENTION

Field of the Invention

The field of art to which the present invention pertains is the treatment of sour petroleum distillate or fractions, the treatment being commonly referred to as sweetening. More specifically, the present invention relates to treating sour petroleum distillates with a supported metal chelate mercaptan oxidation catalyst and anhydrous ammonia in the absence of an aqueous phase.

INFORMATION DISCLOSURE

Processes for the treatment of a sour petroleum distillate wherein said distillate is treated in the presence of an oxidizing agent at alkaline reaction conditions with a supported metal phthalocyanine catalyst dispersed as a fixed bed in a treating or reaction zone, has become well known and widely accepted in the industry. The treating process is typically designed to effect the catalytic oxidation of offensive mercaptans contained in the sour petroleum distillate with the formation of innocuous disulfides. Gasoline, including natural, straight run and cracked gasolines, is the most frequently treated sour petroleum distillate. Other sour petroleum distillates include the normally gaseous petroleum fraction as well as naphtha, kerosene, jet fuel, fuel oil and the like.

A commonly used continuous process for treating sour petroleum distillates entails treating the distillate in contact with a metal phthalocyanine catalyst dispersed in an aqueous caustic solution to yield a doctor sweet product. The sour distillate and the catalyst-containing aqueous caustic solution provide a liquid-liquid system wherein mercaptans are converted to disulfides at the interface of the immiscible solutions in the presence of an oxidizing agent—usually air. Sour petroleum distillates containing more difficultly oxidizable mercaptans are more effectively treated in contact with a metal phthalocyanine catalyst disposed on a high surface area adsorptive support—usually a metal phthalocyanine on an activated charcoal. The distillate is treated in contact with the supported metal phthalocyanine catalyst at oxidation conditions in the presence of an aqueous-phase alkaline agent. One such process is described in U.S. Pat. No. 2,988,500. The oxidizing agent is most often air admixed with the distillate to be treated, and the aqueous-phase alkaline agent is most often an aqueous caustic solution charged continuously to the process or intermittently as required to maintain the catalyst in a caustic-wetted state.

The prior art recognizes that there are limitations on the ability to treat a sour petroleum distillate with a catalytic composite consisting of a metal phthalocyanine disposed on a carrier material such as the relatively short catalyst life and the required utilization of aqueous-phase alkaline reagents. Various improvements have been developed to further enhance the sweetening ability including the use of certain additives in the distillate treating process. However, the prior art does not disclose or suggest that a sour mercaptan-containing hydrocarbon distillate may be more effectively treated by a method comprising contacting the distillate at oxidation conditions with a supported metal chelate mercaptan oxidation catalyst and anhydrous ammonia in the absence of an aqueous phase. We have discovered surprising and unexpected results when utilizing a supported metal chelate mercaptan oxidation catalyst and anhydrous ammonia in the absence of an aqueous phase to sweeten hydrocarbon distillates.

SUMMARY OF THE INVENTION

One embodiment of the present invention is a process for sweetening a sour hydrocarbon fraction containing mercaptan which comprises reacting mercaptans contained in the hydrocarbon fraction with an oxidizing agent by contacting the hydrocarbon fraction and the oxidizing agent with a supported metal chelate mercaptan oxidation catalyst and anhydrous ammonia in the absence of an aqueous phase.

Other embodiments of the present invention encompass further details such as feedstocks, catalyst carrier materials, preferred catalyst compositions and process operating conditions, all of which are hereinafter disclosed in the following discussion of each of these facets of the invention.

BRIEF DESCRIPTION OF THE DRAWING

The drawing is a graphical comparison of the performance of the process of the present invention with the performance of a process of the prior art.

DETAILED DESCRIPTION OF THE INVENTION

We have discovered that a supported metal chelate mercaptan oxidation catalyst and anhydrous ammonia in the absence of an aqueous phase display improved sweetening of hydrocarbon distillates. The outstanding characteristics of our invention have permitted the sweetening of hydrocarbons without the addition of aqueous-phase alkaline reagents while maintaining extended mercaptan conversion activity. The prior art has generally relied upon the presence of aqueous-phase alkaline reagents to retard the rapid deactivation of metal chelate catalyst during hydrocarbon sweetening. The presence of aqueous-phase alkaline reagents was considered to be a necessary element for the sweetening reaction and one which is to be tolerated. The usage of aqueous-phase alkaline reagents was undesirable in that the provision of the alkaline reagent was an added expense, the post-treatment separation of the aqueous-phase alkaline reagent from the product had to be ensured, the compatibility of the processing unit had to be maintained with regard to the chemically agressive characteristics of many of the aqueous-phase alkaline reagents and the spent aqueous-phase alkaline reagents had to be disposed of in an environmentally acceptable manner.

The sweetening process inherently produces oxidation products which include water. However, in accordance with the present invention, a separate water phase is not present during processing. The lack of a separate water phase is in some part due to the fact that the mercaptan level in the hydrocarbon feedstock, and therefore the resulting water level, is so low that the solubility of water in the hydrocarbon product is not exceeded. This lack of a separate water phase is also due in part to the fact that some of the reduction products of dioxygen are peroxides and oxygen-containing organic molecules which are soluble in the hydrocarbon product. For these reasons, the ammonia is maintained in the hydrocarbon phase and in accordance with the present invention a separate aqueous-phase alkaline reagent is not allowed to be formed or to be present.

As mentioned above, the prior art has long recognized the ability of phthalocyanine catalyst to oxidize mercaptans, but those skilled in the art have failed to discover the surprising and totally unexpected results of our invention.

The supported metal chelate catalyst of the present invention comprises a carrier material and the catalytically active metal chelate. The metal chelate mercaptan oxidation catalyst employed as a component of the catalytic composite of this invention can be any of the various metal chelates known to the treating art as effective to catalyze the oxidation of mercaptans contained in a sour petroleum distillate with the formation of polysulfide oxidation products. Said chelates include the metal compounds of tetrapyridinoporphyrazine described in U.S. Pat. No. 3,980,582, e.g., cobalt tetrapyridinoporphyrazine; porphyrin and metaloporphyrin catalysts as described in U.S. Pat. No. 2,966,453, e.g., cobalt tetraphenylporphyrin sulfonate; corriniod catalysts as described in U.S. Pat. No. 3,252,892, e.g., cobalt corrin sulfonate; chelate organo-metallic catalysts such as described in U.S. Pat. No. 2,918,426, e.g., the condensation product of an aminophenol and a metal of Group VIII; and the like. Metal phthalocyanines are a preferred class of metal chelate mercaptan oxidation catalysts.

The carrier material herein contemplated includes the various and well-known adsorbent materials in general use as catalyst supports. Preferred carrier materials include the various charcoals produced by the destructive distillation of wood, peat, lignite, nut shells, bones, and other carbonaceous matter, and preferably such charcoals as have been heat treated, or chemically treated, or both, to form a highly porous particle structure of increased adsorbent capacity, and generally defined as activated charcoal. Said carrier materials also include the naturally occuring clays and silicates, for example, diatomaceous earth, fuller's earth, kieselguhr, attapulgus clay, feldspar, montmorillonite, halloysite, kaolin, and the like, and also the naturally occuring or synthetically prepared refractory inorganic oxides such as alumina, silica, zirconia, thoria, boria, etc., or combinations thereof, like silica-alumina, silica-zirconia, alumina-zirconia, etc. Any particular carrier material is selected with regard to its stability under conditions of its intended use. For example, in the treatment of a sour petroleum distillate, the carrier material should be insoluble in, and otherwise inert to, the petroleum distillate at conditions typically existing in the treating zone. Charcoal, and particularly activated charcoal, is preferred because of its capacity for metal phthalocyanine and because of its stability under treating conditions. However, it should be observed that the method of this invention is also applicable to the preparation of a metal chelate composited with any of the other well-known carrier materials, particularly the refractory inorganic oxides.

The metal phthalocyanines which may be employed to catalyze the oxidation of mercaptans contained in sour petroleum distillates generally include magnesium phthalocyanine, titanium phthalocyanine, hafnium phthalocyanine, vanadium phthalocyanine, tantalum phthalocyanine, molybdenum phthalocyanine, manganese phthalocyanine, iron phthalocyanine, cobalt phthalocyanine, nickel phthalocyanine, platinum phthalocyanine, palladium phthalocyanine, copper phthalocyanine, silver phthalocyanine, zinc phthalocyanine, tin phthalocyanine, and the like. Cobalt phthalocyanine, iron phthalocyanine, manganese phthalocyanine and vanadium phthalocyanine are particularly preferred. The metal phthalocyanine is more frequently employed as a derivative thereof, the commercially available sulfonated derivatives, e.g., cobalt phthalocyanine monosulfonate, cobalt phthalocyanine disulfonate or a mixture thereof being particularly preferred. The sulfonated derivatives may be prepared, for example, by reacting cobalt, vanadium, or other metal phthalocyanine with fuming sulfuric acid. While the sulfonated derivatives are preferred, it is understood that other derivatives, particularly the carboxylated derivatives, may be employed. The carboxylated derivatives are readily prepared by the action of trichloroacetic acid on the metal phthalocyanine.

The composite of metal chelates and a carrier may be prepared in any suitable manner. In one method the carrier may be formed into particles of uniform or irregular size and the carrier is intimately contacted with a solution of phthalocyanine catalyst. An aqueous or alkaline solution of the phthalocyanine catalyst is prepared and, in a preferred embodiment, the carrier particles are soaked, dipped, suspended or immersed in the solution. In another method, the solution may be sprayed onto, poured over or otherwise contacted with the carrier. Excess solution may be removed in any suitable manner and the carrier containing the catalyst allowed to dry at ambient temperature, dried in an oven or by means of hot gases passed thereover, or in any other suitable manner. In general, it is preferred to composite as much phthalocyanine with the carrier as will form a stable composite, although a lesser amount may be so deposited, if desired. In one preparation, a cobalt phthalocyanine sulfonate was composited with activated carbon by soaking granules of carbon in phthalocyanine solution. In another method, the carrier may be deposited in the treating zone and the phthalocyanine solution passed therethrough in order to form the catalyst composite.

A preferred method of contacting the supported metal chelate mercaptan oxidation catalyst and the anhydrous ammonia with the hydrocarbon feedstock is to install the supported catalyst in a fixed bed inside the treating zone. The method of supporting beds of solid catalyst in treating zones is well known and need not be described in detail herein. The anhydrous ammonia is then introduced to the treating zone. The introduction of anhydrous ammonia may be performed by combination with the hydrocarbon feedstock or with the oxidizing agent, or the anhydrous ammonia may be introduced to the reactor directly as a separate stream. The anhydrous ammonia is preferably present in the treating zone in an amount from about 10 to about 10,000 ppm by weight based on hydrocarbon feedstock.

Treating of the sour hydrocarbon distillate in a treating zone generally is effected at ambient temperature, although elevated temperature may be used but will not generally exceed about 300° F. Atmospheric pressure is usually employed, although super-atmospheric pressure up to about 1000 psig may be employed if desired. The time of contact in the treating zone may be selected to give the desired reduction in mercaptan content and may range from about 0.1 to about 48 hours or more, depending upon the size of the treating zone, the amount of catalyst and the particular hydrocarbon distillate being treated. More specifically, contact times equivalent to a liquid hourly space velocity from about 0.5 to about 15 or more are effective to achieve a desired reduction in the mercaptan content of a sour hydrocarbon distillate.

As previously stated, sweetening of the sour petroleum distillate is effected by oxidizing the mercaptan content thereof to disulfides. Accordingly, the process is effected in the presence of an oxidizing agent, preferably air, although oxygen or other oxygen-containing gas may be employed. In fixed bed treating operations, the sour petroleum distillate may be passed upwardly or downwardly through the catalyst bed. The sour petroleum distillate may contain sufficient entrained air, but generally added air is admixed with the distillate and charged to the treating zone concurrently therewith. In some cases, it may be of advantage to charge the air separately to the treating zone and countercurrent to the distillate separately charged thereto.

An optional component of the catalyst is a quaternary ammonium salt which is represented by the structural formula:

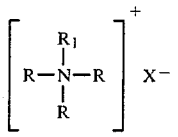

wherein R is a hydrocarbon radical containing up to about 20 carbon atoms and selected from the group consisting of alkyl, cycloalkyl, aryl, alkaryl and aralkyl, $R_1$ is a substantially straight chain alkyl radical containing from about 5 to about 20 carbon atoms, and X is an anion selected from the group consisting of halide, nitrate, nitrite, sulfate, phosphate, acetate, citrate and tartrate. $R_1$ is preferably an alkyl radical containing from about 12 to about 18 carbon atoms, at least one R is preferably benzyl, and X is preferably chloride. Preferred quaternary ammonium salts thus include benzyldimethyldodecylammonium chloride, benzyldimethyltetradecylammonium chloride, benzyldimethylhexadecylammonium chloride, benzyldimethyloctadecylammonium chloride, and the like. Other suitable quaternary ammonium salts are disclosed in U.S. Pat. No. 4,157,312 which is incorporated herein by reference.

The catalyst utilized in the present invention preferably contains a metal chelate in the amount from about 0.01 to about 20 weight percent of the finished catalyst. In the event that the catalyst contains a quaternary ammonium salt, it is preferred that said salt is present in an amount from about 1 to about 50 weight percent of the finished catalyst.

The prior art has taught that without the stabilizing effect of aqueous-phase alkaline reagents during mercaptan oxidation, the life of the metal chelate catalyst is shortened by toxin molecules which, it is believed, are formed from the mercaptans. The principal oxidation product is a disulfide and disulfides are not believed to be toxins. The resulting toxins are minor oxidation products but relatively minor amounts are sufficient to cause a noticeable catalyst deactivation. Additionally, it is believed by those skilled in the prior art that the water produced during the oxidation of mercaptan containing hydrocarbons contribute to the instability of metal chelate catalysts. Previously the disadvantage of catalyst deactivation had been minimized by the use of the addition of an aqueous-phase alkaline reagent to the oxidation zone. Since the handling and use of aqueous-phase alkaline reagents have inherent disadvantages as hereinabove mentioned, hydrocarbon refiners have been actively seeking a hydrocarbon sweetening process which does not utilize the addition of an aqueous-phase alkaline reagent. We have discovered that the addition of anhydrous ammonia to a process for sweetening a sour hydrocarbon fraction with a supported metal chelate mercaptan oxidation catalyst in the absence of an aqueous phase provides for a surprising and unexpected improvement in the longevity of the catalyst and the resulting product quality as more fully described and explained in the following example.

The following example is given to illustrate further our process for sweetening a sour hydrocarbon fraction containing mercaptan. The example is not to be construed as an undue limitation on the generally broad scope of the invention as set out in the appended claims and is therefore intended to be illustrative rather than restrictive.

EXAMPLE

A catalytic composite which is known in the prior art for the oxidation of mercaptans and comprises cobalt phthalocyanine sulfonate and a quaternary ammonium salt on activated charcoal was prepared in the following manner. An impregnating solution was formulated by adding 0.15 grams of cobalt phthalocyanine monosulfonate and 4 grams of a 50% alcoholic solution of dimethylbenzylalkylammonium chloride to 150 ml of deionized water. About 100 cc of 10×30 mesh activated charcoal particles were immersed in the impregnating solution and allowed to stand until the blue color disappeared from the solution. The resulting impregnated charcoal was filtered, water washed and dried in an oven for about one hour at 212° F. A portion of the catalytic composite thus prepared was subjected to a comparative evaluation test, hereinafter Run A, which consisted in processing a sour FCC gasoline containing about 550 ppm mercaptan downflow through the catalyst disposed as a fixed bed in a vertical tubular reactor. The FCC gasoline was charged at a liquid hourly space velocity (LHSV) of about 8 together with an amount of air sufficient to provide about two times the stoichiometric amount of oxygen required to oxidize the mercaptans contained in the FCC gasoline. No caustic or any other alkaline reagent was charged to the reactor before or during the test. The treated FCC gasoline was analyzed periodically for mercaptan sulfur. The mercaptan sulfur content of the treated FCC gasoline was plotted against the hours on stream to provide the curve presented in the drawing and identified as Run A.

A second comparative evaluation test, hereinafter Run B, which is a preferred embodiment of the present invention, was conducted with another portion of fresh catalyst prepared as hereinabove described. Run B was conducted at the same conditions as Run A with the exception that 100 ppm by weight of anhydrous ammonia based on the fresh feed hydrocarbon was introduced into the reactor. No caustic or any other alkaline reagent was charged to the reactor before or during the test. The treated FCC gasoline was analyzed periodically for mercaptan sulfur. The mercaptan sulfur content of the treated FCC gasoline was plotted against the hours on stream to provide the curve presented in the drawing and identified as Run B. The maximum commercially acceptable mercaptan level in FCC gasoline is about 10 ppm.

From the drawing, it is apparent that when a supported mercaptan oxidation catalyst was used to sweeten an FCC gasoline without the addition of an aqueous-phase alkaline reagent to the reactor, as shown by Run A, the time period during which commercially acceptable product was produced was about 25 hours. However, on the other hand, when the same system was operated with an anhydrous ammonia addition of about 100 ppm by weight based on fresh feed hydrocarbon as shown by Run B, a commercially acceptable product was produced for about 60 hours or nearly a three-fold improvement over the prior art process. Therefore, the discovery of a hydrocarbon sweetening process which performs in the absence of the addition of an aqueous-phase alkaline reagent is an extraordinary advance in the art of sweetening.

The Example shows that a sweetening process not using an aqueous-phase alkaline reagent has a very poor catalyst life. The prior art has repeatedly taught that a successful sweetening process is achieved by the addition of an aqueous-phase alkaline reagent during the sweetening process. Those skilled in the prior art of sweetening have desired and searched for a sweetening process which will satisfactorily operate in the absence of an aqueous phase. We have discovered that the addition of anhydrous ammonia in the absence of an aqueous phase has unexpectedly and surprisingly provided a sweetening process which displays improved catalyst life compared with the prior art.

The foregoing description, drawing and example clearly demonstrate that an improved sweetening process is available when anhydrous ammonia injection is performed in the absence of an aqueous phase.

We claim as our invention:

1. A process for sweetening a sour hydrocarbon fraction containing mercaptan which comprises reacting mercaptans contained in said hydrocarbon fraction with an oxidizing agent by contacting said hydrocarbon fraction and said oxidizing agent with a supported metal chelate mercaptan oxidation catalyst and anhydrous ammonia in the absence of an aqueous phase.

2. The process of claim 1 wherein said sour hydrocarbon fraction is gasoline.

3. The process of claim 1 wherein said sour hydrocarbon fraction is kerosene.

4. The process of claim 1 wherein said oxidizing agent is air.

5. The process of claim 1 wherein said supported metal chelate mercaptan oxidation catalyst comprises a carbon support.

6. The process of claim 1 wherein said supported metal chelate mercaptan oxidation catalyst comprises an inorganic oxide support.

7. The process of claim 1 wherein said supported metal chelate mercaptan oxidation catalyst comprises cobalt phthalocyanine sulfonate.

8. The process of claim 1 wherein said supported metal chelate mercaptan oxidation catalyst comprises from about 0.1 to about 20 weight percent metal chelate based on the finished catalyst.

9. The process of claim 1 wherein said supported metal chelate mercaptan oxidation catalyst comprises a quaternary ammonium salt.

10. The process of claim 9 wherein said quaternary ammonium salt is present in an amount from about 1 to about 50 weight percent of the finished catalyst.

11. The process of claim 9 wherein said quaternary ammonium salt is dimethylbenzylalkylammonium chloride.

12. The process of claim 1 wherein said anhydrous ammonia is present in an amount from about 10 to about 10,000 ppm by weight based on hydrocarbon feedstock.

* * * * *